US010687162B2

(12) United States Patent
Chon et al.

(10) Patent No.: US 10,687,162 B2
(45) Date of Patent: Jun. 16, 2020

(54) METHOD AND APPARATUS FOR RENDERING ACOUSTIC SIGNAL, AND COMPUTER-READABLE RECORDING MEDIUM

(71) Applicant: SAMSUNG ELECTRONICS CO., LTD., Suwon-si (KR)

(72) Inventors: Sang-bae Chon, Suwon-si (KR); Sun-min Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/504,896

(22) Filed: Jul. 8, 2019

(65) Prior Publication Data

US 2019/0335284 A1 Oct. 31, 2019

Related U.S. Application Data

(63) Continuation of application No. 16/192,278, filed on Nov. 15, 2018, now Pat. No. 10,382,877, which is a (Continued)

(51) Int. Cl.
*H04S 7/00* (2006.01)
*G10L 19/008* (2013.01)

(52) U.S. Cl.
CPC ..... *H04S 7/30* (2013.01); *G10L 19/008* (2013.01); *H04S 2400/03* (2013.01)

(58) Field of Classification Search
CPC ..... H04S 7/30; H04S 2400/03; G10L 19/008
See application file for complete search history.

(56) References Cited

U.S. PATENT DOCUMENTS 7,190,794 B2 3/2007 Hinde
7,630,890 B2 12/2009 Son et al.

(Continued)

FOREIGN PATENT DOCUMENTS

CN 1703118 A 11/2005
CN 101032186 A 9/2007

(Continued)

OTHER PUBLICATIONS

International Search Report and Written Opinion dated Jun. 16, 2015, issued by the International Searching Authority in counterpart International Application No. PCT/KR2015/003130 (PCT/ISA/210 & 237).

(Continued)

*Primary Examiner* — Andrew L Sniezek
(74) *Attorney, Agent, or Firm* — Sughrue Mion, PLLC

(57) ABSTRACT

When a multi-channel signal, such as from a 22.2 channel, is rendered to a 5.1 channel, three-dimensional audio signals can be reproduced by use of a two-dimensional output channel. However, when the elevation of the input channel differs from the standard elevation and an elevation rendering parameter corresponding to the standard elevation is used, audio image distortion occurs. The present invention resolves the described issue in the existing technology, and a method of rendering audio signals, according to an embodiment of the present invention, which reduces the audio image distortion even when the elevation of the input channel differs from the standard elevation, comprises the steps of: receiving a multi-channel signal comprising a plurality of input channels to be converted into a plurality of output channels; obtaining elevation rendering parameters for a height input channel having a standard elevation angle so that each output channel provides an audio image having a sense of elevation; and updating the elevation rendering (Continued)

parameters for a height input channel having a set elevation angle other than the standard elevation angle.

10 Claims, 15 Drawing Sheets

Related U.S. Application Data continuation of application No. 15/300,077, filed as application No. PCT/KR2015/003130 on Mar. 30, 2015, now Pat. No. 10,149,086.

(60) Provisional application No. 61/971,647, filed on Mar. 28, 2014.

(56) References Cited

U.S. PATENT DOCUMENTS

| | | | |
|---|---|---|---|
| 8,296,155 | B2 | 10/2012 | Pang et al. |
| 8,509,454 | B2 | 8/2013 | Kirkeby et al. |
| 9,426,596 | B2 | 8/2016 | Beack et al. |
| 10,149,086 | B2 | 12/2018 | Chon et al. |
| 10,382,877 | B2 * | 8/2019 | Chon ..... H04S 7/30 |
| 2002/0141597 | A1 | 10/2002 | Wilcock |
| 2002/0150257 | A1 | 10/2002 | Wilcock et al. |
| 2003/0018477 | A1 | 1/2003 | Hinde |
| 2006/0133628 | A1 | 6/2006 | Trivi et al. |
| 2009/0006106 | A1 | 1/2009 | Pang et al. |
| 2012/0213375 | A1 | 8/2012 | Mahabub et al. |
| 2012/0314875 | A1 | 12/2012 | Lee et al. |
| 2015/0213807 | A1 | 7/2015 | Breebaart et al. |
| 2016/0044434 | A1 | 2/2016 | Chon et al. |

FOREIGN PATENT DOCUMENTS

| | | | |
|---|---|---|---|
| CN | 101180674 | A | 5/2008 |
| CN | 101483797 | A | 7/2009 |
| CN | 101689368 | A | 3/2010 |
| CN | 102318372 | A | 1/2012 |
| CN | 102664017 | A | 9/2012 |
| EP | 2469892 | A1 | 6/2012 |
| KR | 1020080089308 | A | 10/2008 |
| RU | 2 406 166 | C2 | 12/2010 |
| RU | 2 504 847 | C2 | 1/2014 |
| WO | 2006/126856 | A2 | 11/2006 |
| WO | 2008/060111 | A1 | 5/2008 |
| WO | 2008/120933 | A1 | 10/2008 |
| WO | 2009/048239 | A2 | 4/2009 |
| WO | 2014/020181 | A1 | 2/2014 |
| WO | 2014021588 | A1 | 2/2014 |
| WO | 2014/032709 | A1 | 3/2014 |
| WO | 2014041067 | A1 | 3/2014 |

OTHER PUBLICATIONS

Communication dated Jun. 22, 2017, issued by the Australian Patent Office in counterpart Australian Application No. 2015237402.

Young Woo Lee et al.. "Virtual Height Speaker Rendering for Samsung 10.2-channel Vertical Surround System", Audio Engineering Society Convention Paper 8523; Presented at the 131st Convention, Oct. 20, 2011-Oct. 23, 2011, New York, NY, USA, pp. 1-10, Retrieved from the Internet: URL:http://www.aes.org/e-lib/inst/download.cfm/16049.pdf?ID-16049 [retrieved on Nov. 29, 2016], XP055323908, (ten (10) pages total).

Communication dated Oct. 23, 2017 by the State Intellectual property Office of P.R. China in counterpart Chinese Patent Application No. 201580028236.9.

Communication dated Feb. 19, 2018, issued by the Canadian Patent Office in counterpart Canadian application No. 2,944,355.

Communication dated Oct. 5, 2017 by the European Patent Office in counterpart European Patent Application No. 15767786.5.

Communication dated Jul. 5, 2017, issued by the Canadian Intellectual Property Office in counterpart Canadian Application No. 2,944,355.

Communication dated Dec. 14, 2017, issued by the Russian Patent Office in counterpart Russian application No. 2016142274.

Communication dated Dec. 14, 2017 by the Australia Patent Office in counterpart Australian Patent Application No. 2015237402.

Sung Young, "Surround Audio Column 9.2 VBAP", Audioguy, May 28, 2008, (http://audioguy.co.kr/board/bbs/board.php?bo_table=c_surround&wr_id=127&sst=wr_good&sod=asc&sop=and&page=I), total 5 pages (See p. 1).

Communication dated Jul. 3, 2019, issued by the Australian Patent Office in counterpart Australian Application No. 2018204427.

Communication dated Mar. 3, 2020 by the State Intellectual property Office of P.R. China in counterpart Chinese Patent Application No. 201810662693.9.

Communication dated Feb. 7, 2020 by the State Intellectual property Office of P.R. China in counterpart Chinese Patent Application No. 201810661517.3.

Communication dated Apr. 7, 2020, issued by the Brazilian Patent Office in counterpart Brazilian Application No. BR112016022559-7.

* cited by examiner

METHOD AND APPARATUS FOR RENDERING ACOUSTIC SIGNAL, AND COMPUTER-READABLE RECORDING MEDIUM

CROSS REFERENCE TO RELATED APPLICATIONS

This application is a Continuation Application of U.S. application Ser. No. 16/192,278, filed Nov. 15, 2018, which is a Continuation Application of U.S. application Ser. No. 15/300,077, filed Sep. 28, 2016, which is a National stage entry of International Application No. PCT/KR2015/003130, filed on Mar. 30, 2015, which claims the benefit of U.S. Provisional Application No. 61/971,647, filed on Mar. 28, 2014, in the United States Patent and Trademark Office. The disclosures of each of the Applications are herein incorporated by reference in their entireties.

TECHNICAL FIELD

The present invention relates to a method and apparatus for rendering an audio signal and, more specifically, to a rendering method and apparatus for more accurately reproducing a location and a tone of an audio image than before by correcting an elevation panning coefficient or an elevation filter coefficient when an elevation of an input channel is higher or lower than an elevation according to a standard layout.

BACKGROUND ART

A stereophonic sound indicates a sound having a sense of ambience by reproducing not only a pitch and a tone of the sound but also a direction and a sense of distance, and having additional spatial information by which an audience, who is not located in a space where a sound source is generated, is aware of a sense of direction, a sense of distance, and a sense of space.

When a multi-channel signal, such as from 22.2 channels, is rendered to 5.1 channels, a three-dimensional stereophonic sound can be reproduced by means of a two-dimensional output channel. However, when an elevation angle of an input channel differs from a standard elevation angle and an input signal is rendered using rendering parameters determined according to the standard elevation angle, audio image distortion occurs.

DETAILED DESCRIPTION OF THE INVENTION

Technical Problem

As described above, when a multi-channel signal, such as from 22.2 channels, is rendered to 5.1 channels, three-dimensional audio signals can be reproduced by means of a two-dimensional output channel. However, when an elevation angle of an input channel differs from a standard elevation angle and an input signal is rendered using rendering parameters determined according to the standard elevation angle, audio image distortion occurs.

The purpose of the present invention is to resolve the above-described issue in the existing technology and to reduce the audio image distortion even when the elevation of the input channel is higher or lower than the standard elevation.

Technical Solution

The representative configuration of the present invention to achieve the purpose described above is as follows.

According to an aspect of an embodiment, a method of rendering an audio signal includes the steps of: receiving a multi-channel signal including a plurality of input channels to be converted into a plurality of output channels; obtaining elevation rendering parameters for a height input channel having a standard elevation angle to provide elevated sound image by the plurality of output channels; and updating the elevation rendering parameters for a height input channel having a predetermined elevation angle other than the standard elevation angle.

Advantageous Effects of the Invention

According to the present invention, a three-dimensional audio signal may be rendered so that audio image distortion is reduced even when an elevation of an input channel is higher or lower than a standard elevation.

BEST MODE

Figure 1:
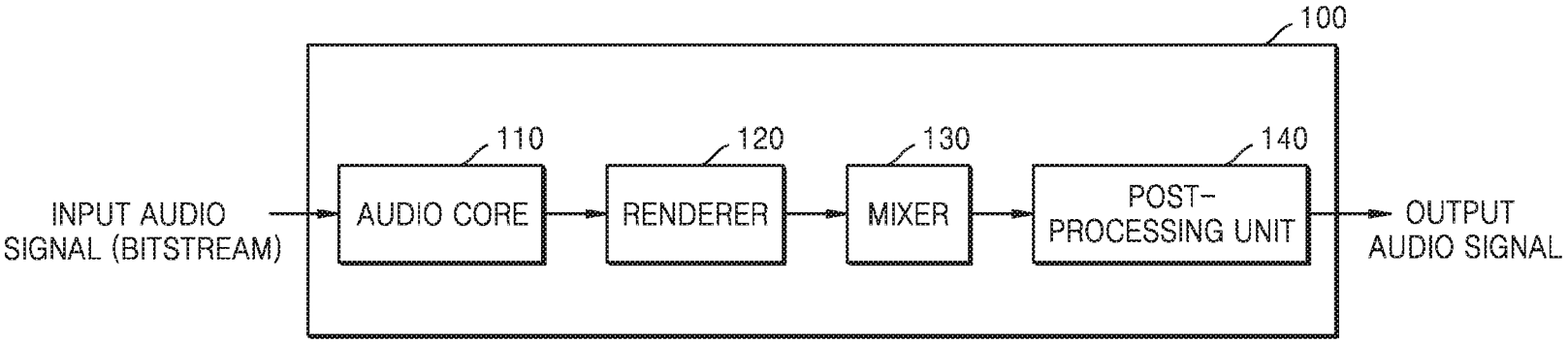
FIG. 1 is a block diagram illustrating an internal structure of a stereophonic audio reproducing apparatus according to an embodiment.

The representative configurations of the present invention to achieve the purpose described above are as follows.

According to an aspect of an embodiment, a method of rendering an audio signal includes the steps of: receiving a multi-channel signal including a plurality of input channels to be converted into a plurality of output channels; obtaining an elevation rendering parameter for a height input channel having a standard elevation angle so that each output channel provides an audio image having a sense of elevation; and updating the elevation rendering parameter for a height input channel having a set elevation angle other than the standard elevation angle.

The elevation rendering parameter includes at least one of elevation filter coefficients and elevation panning coefficients.

The elevation filter coefficients are calculated by reflecting a dynamic characteristic of an HRTF.

The step of updating the elevation rendering parameter includes the step of applying a weight to the elevation filter coefficients based on the standard elevation angle and the set elevation angle.

The weight is determined so that an elevation filter feature is gently exhibited when the set elevation angle is less than the standard elevation angle, and is determined so that the elevation filter feature is strongly exhibited when the set elevation angle is greater than the standard elevation angle.

The step of updating the elevation rendering parameter includes the step of updating the elevation panning coefficients based on the standard elevation angle and the set elevation angle.

When the set elevation angle is less than the standard elevation angle, updated elevation panning coefficients to be applied to output channels existing to be ipsilateral to an output channel having the set elevation angle among the updated elevation panning coefficients are greater than elevation panning coefficients before the update, and a sum of squares of the updated elevation panning coefficients to be respectively applied to the output channels is 1.

When the set elevation angle is greater than the standard elevation angle, updated elevation panning coefficients to be applied to output channels existing to be ipsilateral to an output channel having the set elevation angle among the updated elevation panning coefficients are less than elevation panning coefficients before the update, and a sum of squares of the updated elevation panning coefficients to be respectively applied to the output channels is 1.

The step of updating the elevation rendering parameter includes the step of updating the elevation panning coefficients based on the standard elevation angle and a threshold value when the set elevation angle is the threshold value or more.

The method further includes the step of receiving an input of the set elevation angle.

The input is received from a separate apparatus.

The method includes the steps of: rendering the received multi-channel signal based on the updated elevation rendering parameter; and transmitting the rendered multi-channel signal to the separate apparatus.

According to an aspect of another embodiment, an apparatus for rendering an audio signal includes: a reception unit for receiving a multi-channel signal including a plurality of input channels to be converted into a plurality of output channels; and a rendering unit for obtaining an elevation rendering parameter for a height input channel having a standard elevation angle so that each output channel provides an audio image having a sense of elevation and updating the elevation rendering parameter for a height input channel having a set elevation angle other than the standard elevation angle.

The elevation rendering parameter includes at least one of elevation filter coefficients and elevation panning coefficients.

The elevation filter coefficients are calculated by reflecting a dynamic characteristic of an HRTF.

The updated elevation rendering parameter includes elevation filter coefficients to which a weight is applied based on the standard elevation angle and the set elevation angle.

The weight is determined so that an elevation filter feature is gently exhibited when the set elevation angle is less than the standard elevation angle, and is determined so that the elevation filter feature is strongly exhibited when the set elevation angle is greater than the standard elevation angle.

The updated elevation rendering parameter includes elevation panning coefficients updated based on the standard elevation angle and the set elevation angle.

When the set elevation angle is less than the standard elevation angle, updated elevation panning coefficients to be applied to output channels existing to be ipsilateral to an output channel having the set elevation angle among the updated elevation panning coefficients are greater than elevation panning coefficients before the update, and a sum of squares of the updated elevation panning coefficients to be respectively applied to the output channels is 1.

When the set elevation angle is greater than the standard elevation angle, updated elevation panning coefficients to be applied to output channels existing to be ipsilateral to an output channel having the set elevation angle among the updated elevation panning coefficients are less than elevation panning coefficients before the update, and a sum of squares of the updated elevation panning coefficients to be respectively applied to the output channels is 1.

The updated elevation rendering parameter includes elevation panning coefficients updated based on the standard elevation angle and a threshold value when the set elevation angle is the threshold value or more.

The apparatus further includes an input unit for receiving an input of the set elevation angle.

The input is received from a separate apparatus.

The rendering unit renders the received multi-channel signal based on the updated elevation rendering parameter, and the apparatus further includes a transmission unit for transmitting the rendered multi-channel signal to the separate apparatus.

According to an aspect of another embodiment, a computer-readable recording medium has recorded thereon a program for executing the method described above.

Besides, another method and another system for implementing the present invention, and a computer-readable recording medium having recorded thereon a computer program for executing the method are further provided.

MODE OF THE INVENTION

The detailed description of the present invention to be described below refers to the accompanying drawings showing, as examples, specific embodiments by which the present invention can be carried out. These embodiments are described in detail so as for those of ordinary skill in the art to sufficiently carry out the present invention. It should be understood that various embodiments of the present invention differ from each other but do not have to be exclusive to each other.

For example, a specific shape, structure, and characteristic set forth in the present specification can be implemented by being changed from one embodiment to another embodiment without departing from the spirit and the scope of the present invention. In addition, it should be understood that locations or a layout of individual components in each embodiment also can be changed without departing from the spirit and the scope of the present invention. Therefore, the detailed description to be described is not for purposes of limitation, and it should be understood that the scope of the present invention includes the claimed scope of the claims and all scopes equivalent to the claimed scope.

Like reference numerals in the drawings denote the same or like elements in various aspects. Also, in the drawings, parts irrelevant to the description are omitted to clearly describe the present invention, and like reference numerals denote like elements throughout the specification.

Hereinafter, embodiments of the present invention will be described in detail with reference to the accompanying drawings so that those of ordinary skill in the art to which the present invention belongs can easily carry out the present invention. However, the present invention can be implemented in various different forms and is not limited to the embodiments described herein.

Throughout the specification, when it is described that a certain element is 'connected' to another element, this includes a case of "being directly connected" and a case of "being electrically connected" via another element in the middle. In addition, when a certain part "includes" a certain component, this indicates that the part may further include another component instead of excluding another component unless there is specially different disclosure.

Hereinafter, the present invention is described in detail with reference to the accompanying drawings.

FIG. 1 is a block diagram illustrating an internal structure of a stereophonic audio reproducing apparatus according to an embodiment.

A stereophonic audio reproducing apparatus 100 according to an embodiment may output a multi-channel audio signal in which a plurality of input channels are mixed to a plurality of output channels to be reproduced. In this case, if the number of output channels is less than the number of input channels, the input channels are down-mixed to meet the number of output channels.

A stereophonic sound indicates a sound having a sense of ambience by reproducing not only a pitch and a tone of the sound but also a direction and a sense of distance, and having additional spatial information by which an audience, who is not located in a space where a sound source is generated, is aware of a sense of direction, a sense of distance, and a sense of space.

In the description below, output channels of an audio signal may indicate the number of speakers through which a sound is output. The greater the number of output channels, the greater the number of speakers through which a sound is output. According to an embodiment, the stereophonic audio reproducing apparatus 100 may render and mix a multi-channel acoustic input signal to output channels to be reproduced so that a multi-channel audio signal having a greater number of input channels can be output and reproduced in an environment having a less number of output channels. In this case, the multi-channel audio signal may include a channel in which an elevated sound can be output.

The channel in which an elevated sound can be output may indicate a channel in which an audio signal can be output by a speaker located above the heads of an audience so that the audience senses elevation. A horizontal channel may indicate a channel in which an audio signal can be output by a speaker located on a horizontal surface to the audience.

The above-described environment having a less number of output channels may indicate an environment in which a sound can be output by speakers arranged on the horizontal surface with no output channels in which an elevated sound can be output.

In addition, in the description below, a horizontal channel may indicate a channel including an audio signal which can be output by a speaker located on the horizontal surface. An overhead channel may indicate a channel including an audio signal which can be output by a speaker located on an elevated position above the horizontal surface to output an elevated sound.

Referring to FIG. 1, the stereophonic audio reproducing apparatus 100 according to an embodiment may include an audio core 110, a renderer 120, a mixer 130, and a post-processing unit 140.

According to an embodiment, the stereophonic audio reproducing apparatus 100 may output channels to be reproduced by rendering and mixing multi-channel input audio signals. For example, the multi-channel input audio signal may be a 22.2-channel signal, and the output channels to be reproduced may be 5.1 or 7.1 channels. The stereophonic audio reproducing apparatus 100 may perform rendering by determining an output channel to correspond to each channel of the multi-channel input audio signal and mix rendered audio signals by synthesizing signals of channels corresponding to a channel to be reproduced and outputting the synthesized signal as a final signal.

An encoded audio signal is input to the audio core 110 in a bitstream format, and the audio core 110 decodes the input audio signal by selecting a decoder tool suitable for a scheme by which the audio signal was encoded.

The renderer 120 may render the multi-channel input audio signal to a multi-channel output channel according to channels and frequencies. The renderer 120 may perform three-dimensional (3D) rendering and 2D rendering of a multi-channel audio signal, each of signals according to an overhead channel and a horizontal channel. A configuration of the renderer and a specific rendering method will be described in more detail with reference to FIG. 2.

The mixer 130 may output a final signal by synthesizing signals of channels corresponding to the horizontal channel by the renderer 120. The mixer 130 may mix signals of channels for each set section. For example, the mixer 130 may mix signals of channels for each I frame.

According to an embodiment, the mixer 130 may perform mixing based on power values of signals rendered to respective channels to be reproduced. In other words, the mixer 130 may determine an amplitude of the final signal or a gain to be applied to the final signal based on the power values of the signals rendered to the respective channels to be reproduced.

The post-processing unit 140 performs a dynamic range control and binauralizing of a multi-band signal for an output signal of the mixer 130 to meet each reproducing device (speaker or headphone). An output audio signal output from the post-processing unit 140 is output by a device such as a speaker, and the output audio signal may be reproduced in a 2D or 3D manner according to processing of each component.

The stereophonic audio reproducing apparatus 100 according to the embodiment shown in FIG. 1 is shown based on a configuration of an audio decoder, and a subsidiary configuration is omitted.

Figure 2:
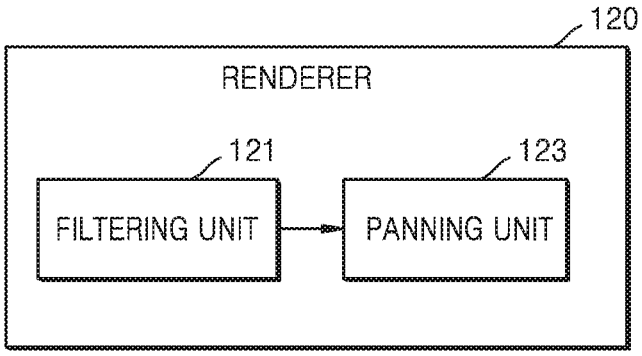
FIG. 2 is a block diagram illustrating a configuration of a renderer in the stereophonic audio reproducing apparatus, according to an embodiment.

FIG. 2 is a block diagram illustrating a configuration of the renderer in the stereophonic audio reproducing apparatus, according to an embodiment.

The renderer 120 includes a filtering unit 121 and a panning unit 123.

The filtering unit 121 may correct a tone and the like of a decoded audio signal according to a location and filter an input audio signal by using a head-related transfer function (HRTF) filter.

The filtering unit 121 may render an overhead channel, which has passed through the HRTF filter, by different methods according to frequencies for 3D rendering of the overhead channel.

The HRTF filter allows recognition of a stereophonic sound by a phenomenon in which not only simple path differences such as an interaural level difference (ILD) and an interaural time difference (ITD) but also complicated path characteristics such as diffraction on a head surface and reflection on auricle vary according to acoustic arrival directions. The HRTF filter may change sound quality of an audio signal to process audio signals included in an overhead channel so that a stereophonic sound can be recognized.

The panning unit 123 obtains and applies a panning coefficient to be applied for each frequency band and each channel to pan an input audio signal to each output channel. Panning of an audio signal indicates controlling a magnitude of a signal to be applied to each output channel in order to render a sound source to a specific location between two output channels.

The panning unit 123 may render a low-frequency signal of an overhead channel signal according to an add-to-the-closest-channel method and render a high-frequency signal according to a multi-channel panning method. According to the multi-channel panning method, a gain value differently set for each channel to be rendered to each channel signal may be applied to a signal of each channel of a multi-channel audio signal so that the signal is rendered to at least one horizontal channel. Signals of respective channels to which gain values are applied may be synthesized through mixing and output as a final signal.

Since a low-frequency signal has a strong diffraction property, even when the low-frequency signal is rendered to only one channel without separately rendering each channel of a multi-channel audio signal to several channels according to the multi-channel panning method, the one channel may exhibit similar sound quality when an audience listens to the low-frequency signal. Therefore, according to an embodiment, the stereophonic audio reproducing apparatus 100 may render a low-frequency signal according to the add-to-the-closest-channel method to prevent deterioration of sound quality which may occur by mixing several channels to one output channel. That is, since sound quality may be deteriorated due to amplification or reduction according to interference between channel signals when several channels are mixed to one output channel, one channel may be mixed to one output channel to prevent sound quality deterioration.

According to the add-to-the-closest-channel method, each channel of a multi-channel audio signal may be rendered to the closest channel among channels to be reproduced instead of being separately rendered to several channels.

In addition, the stereophonic audio reproducing apparatus 100 may widen a sweet spot without deteriorating sound quality by performing rendering by different methods according to frequencies. That is, by rendering a low-frequency signal having a strong diffraction characteristic according to the add-to-the-closest-channel method, sound quality deterioration, which may occur by mixing several channels to one output channel, may be prevented. A sweet spot indicates a predetermined range in which an audience can optimally listen to a stereophonic sound without distortion.

As the sweet spot is wide, the audience may optimally listen to a stereophonic sound without distortion in a wide range, and when the audience is not located in the sweet spot, the audience may listen to a sound with distorted sound quality or audio image.

Figure 3:
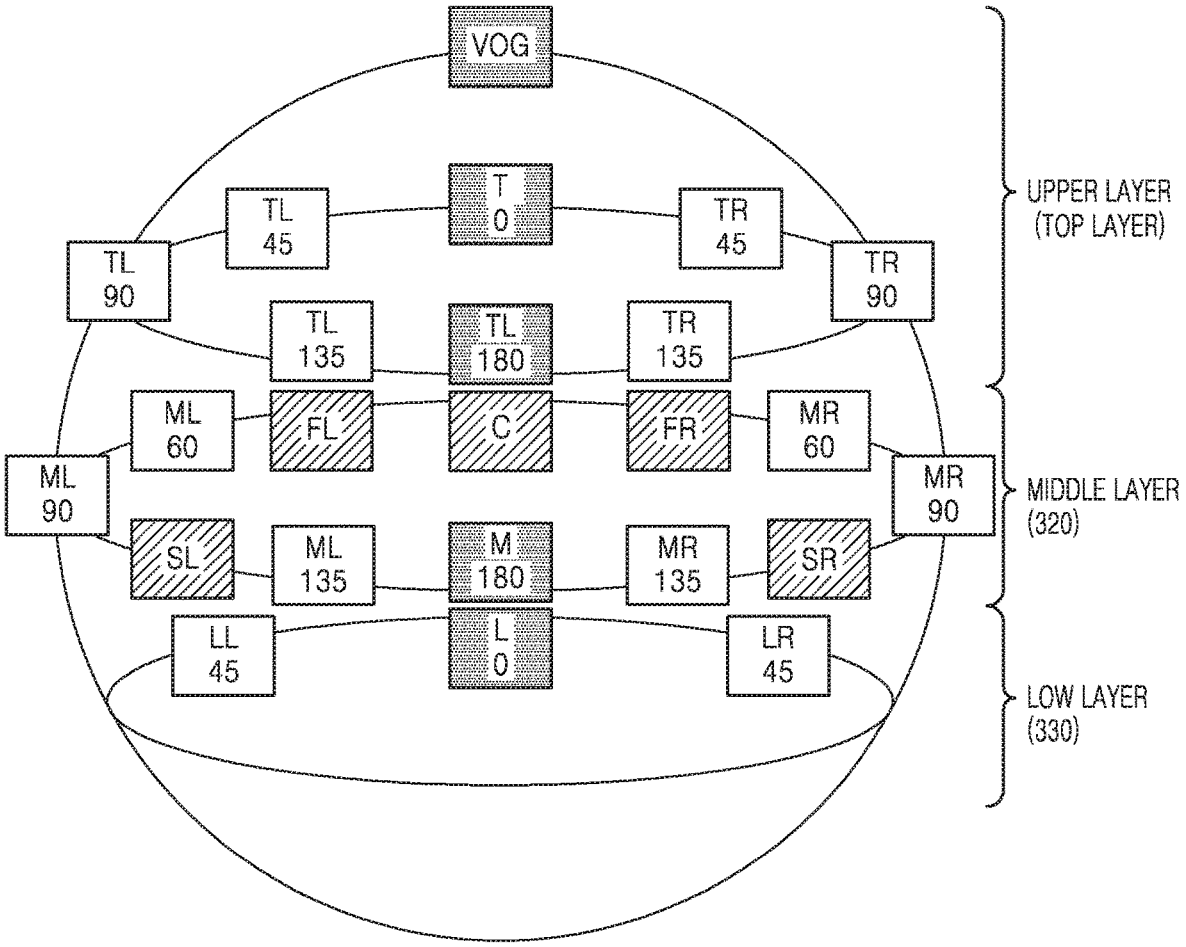
FIG. 3 illustrates a layout of channels when a plurality of input channels are down-mixed to a plurality of output channels, according to an embodiment.

FIG. 3 illustrates a layout of channels when a plurality of input channels are down-mixed to a plurality of output channels, according to an embodiment.

To provide the same or a more exaggerated sense of realism and sense of immersion as or than reality as in a 3D image, techniques for providing a 3D stereophonic sound together with a 3D stereoscopic image have been developed. A stereophonic sound indicates a sound in which an audio signal itself has a sense of elevation and a sense of space of a sound, and to reproduce such a stereophonic sound, at least two loud speakers, i.e., output channels, are necessary. In addition, except for a binaural stereophonic sound using the HRTF, a greater number of output channels are necessary to more accurately reproduce a sense of elevation, a sense of distance, and a sense of space of a sound.

Therefore, a stereo system having two output channels and various multi-channel systems such as a 5.1-channel system, an Auro 3D system, a Holman 10.2-channel system, an ETRI/Samsung 10.2-channel system, and an NHK 22.2-channel system have been proposed and developed.

FIG. 3 illustrates a case where a 22.2-channel 3D audio signal is reproduced by a 5.1-channel output system.

A 5.1-channel system is a general name of a five-channel surround multi-channel sound system and is a system most popularly used as home theaters and cinema sound systems. A total of 5.1 channels include a front left (FL) channel, a center (C) channel, a front right (FR) channel, a surround left (SL) channel, and a surround right (SR) channel. As shown in FIG. 3, since all outputs of the 5.1 channels are on the same plane, the 5.1-channel system physically corresponds to a 2D system, and to reproduce a 3D audio signal by using the 5.1-channel system, a rendering process for granting a 3D effect to a signal to be reproduced must be performed.

The 5.1-channel system is widely used in various fields of not only the movie field but also the DVD image field, the DVD sound field, the super audio compact disc (SACD) field, or the digital broadcasting field. However, although the 5.1-channel system provides an improved sense of space as compared to a stereo system, there are several limitations in forming a wider listening space. Particularly, since a sweet spot is formed to be narrow and a vertical audio image having an elevation angle cannot be provided, the 5.1-channel system may not be suitable for a wide listening space such as a cinema.

The 22.2-channel system proposed by NHK includes three-layer output channels, as shown in FIG. 3. An upper layer 310 includes a voice of god (VOG) channel, a T0 channel, a T180 channel, a TL45 channel, a TL90 channel, a TL135 channel, a TR45 channel, a TR90 channel, and a TR45 channel. Herein, an index T that is the first character of each channel name indicates an upper layer, indices L and R indicate the left and the right, respectively, and the following number indicates an azimuth angle from the center channel. The upper layer is usually called a top layer.

The VOG channel is a channel existing above the heads of an audience, has an elevation angle of 90°, and has no azimuth angle. However, when the VOG channel is wrongly located even a little, the VOG channel has an azimuth angle and an elevation angle that is different from 90°, and thus the VOG channel may not act as the VOG channel any more.

A middle layer 320 is on the same plane as the existing 5.1 channels and includes an ML60 channel, an ML90 channel, an ML135 channel, an MR60 channel, an MR90 channel, and an MR135 channel besides the output channels of the 5.1 channels. Herein, an index M that is the first character of each channel name indicates a middle layer, and the following number indicates an azimuth angle from the center channel.

A low layer 330 includes an L0 channel, an LL45 channel, and an LR45 channel. Herein, an index L that is the first character of each channel name indicates a low layer, and the following number indicates an azimuth angle from the center channel.

In the 22.2 channels, the middle layer is called a horizontal channel, and the VOG, T0, T180, M180, L, and C channels corresponding to an azimuth angle of 0° or 180° are called a vertical channel.

When a 22.2-channel input signal is reproduced using a 5.1-channel system, according to the most general method, an inter-channel signal can be distributed using a down-mix expression. Alternatively, rendering for providing a virtual sense of elevation may be performed so that the 5.1-channel system reproduces an audio signal having a sense of elevation.

FIG. 4 illustrates a layout of top-layer channels according to elevations of a top layer in a channel layout, according to an embodiment.

When an input channel signal is a 22.2-channel 3D audio signal and is arranged according to the layout of FIG. 3, an upper layer among input channels has a layout as shown in FIG. 4. In this case, it is assumed that elevation angles are 0°, 25°, 35°, and 45°, and the VOG channel corresponding to an elevation angle of 90° is omitted. The upper-layer channels having an elevation angle of 0° are as if they were located on a horizontal surface (the middle layer 320).

Figure 4A:
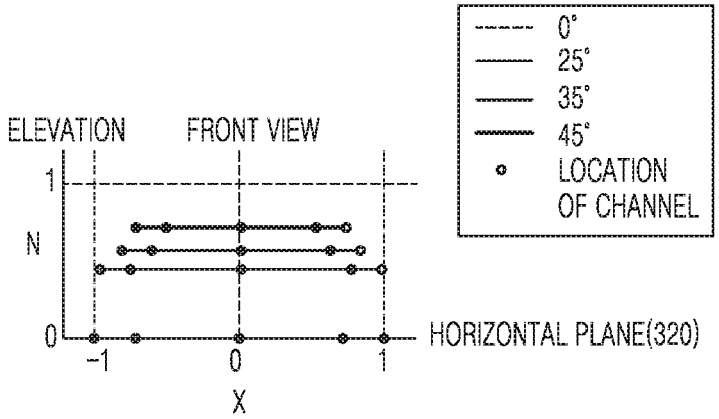
FIG. 4A illustrates a channel layout when upper-layer channels are viewed from the front.

FIG. 4A illustrates a channel layout when the upper-layer channels are viewed from the front.

Referring to FIG. 4A, since the eight upper-layer channels have an azimuth angle difference of 45° therebetween, when the upper-layer channels are viewed from the front based on a vertical channel axis, the six channels remaining by excluding the TL90 channel and the TR90 channel are shown such that the TL45 channel and the TL135 channel, the T0 channel and the T180 channel, and the TR45 channel and the TR135 channel overlap two by two. This will be clearer as compared with FIG. 4B.

Figure 4B:
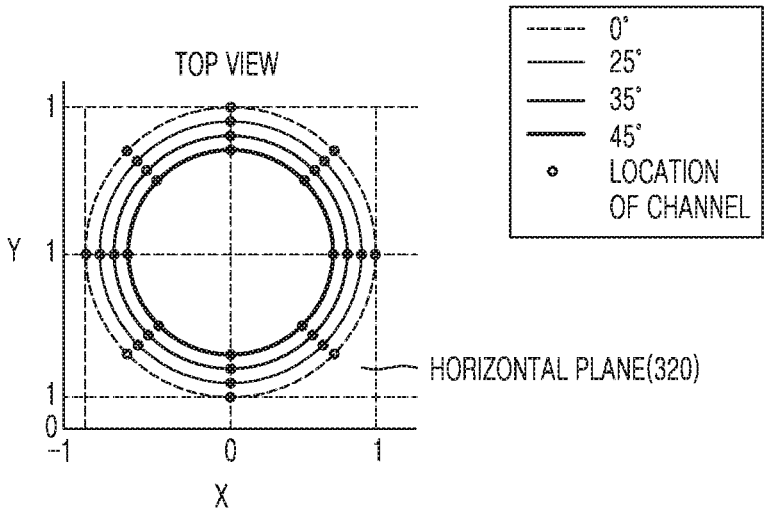
FIG. 4B illustrates a channel layout when the upper-layer channels are viewed from the top.
Figure 4C:
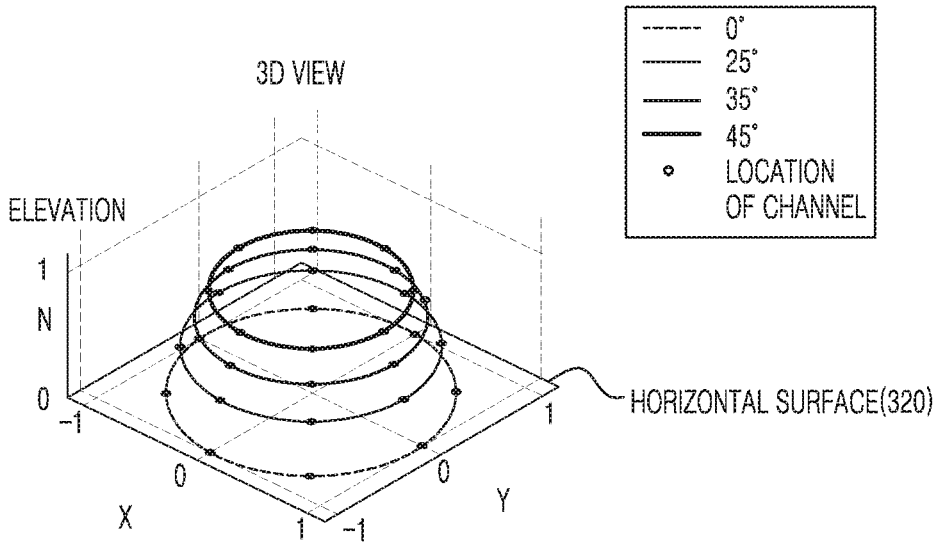
FIG. 4C illustrates a three-dimensional layout of the upper-layer channels.

FIG. 4B illustrates a channel layout when the upper-layer channels are viewed from the top. FIG. 4C illustrates a 3D layout of the upper-layer channels. It can be seen that the eight upper-layer channels are arranged with an equal interval and an azimuth angle difference of 45° therebetween.

If content to be reproduced as a stereophonic sound through elevation rendering is fixed to have, for example an elevation angle of 35°, it will be fine even though the elevation rendering is performed for all input audio signals at an elevation angle of 35°, and an optimal result may be obtained.

However, according to content, an elevation angle may be applied to a stereophonic sound of corresponding content, and as shown in FIG. 4, a location and a distance of each channel varies according to elevations of channels, and accordingly a signal characteristic may also vary.

Therefore, when virtual rendering is performed at a fixed elevation angle, audio image distortion occurs, and to obtain an optimal rendering performance, it is necessary to perform rendering by taking into account an elevation angle of an input 3D audio signal, i.e., an elevation angle of an input channel.

Figure 5:
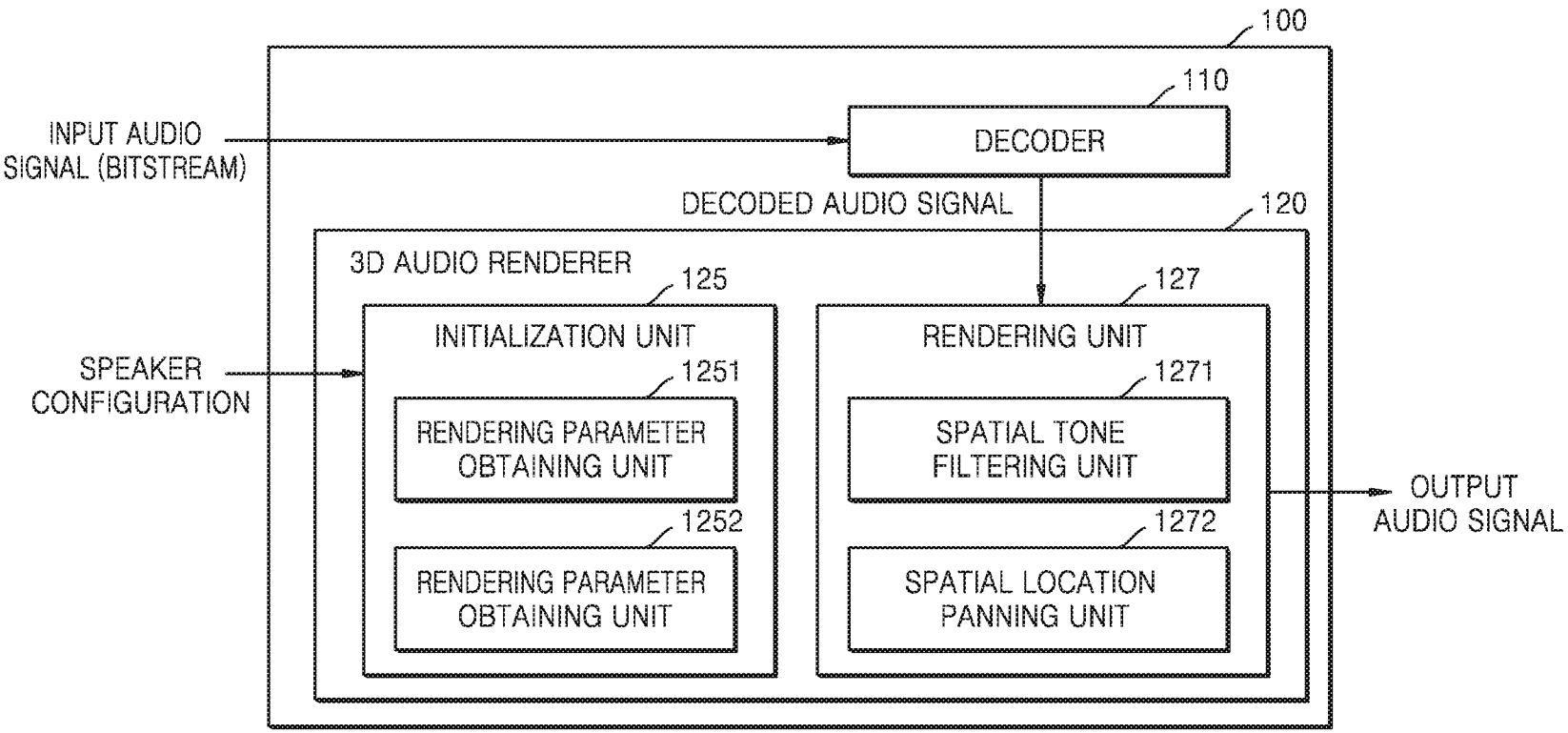
FIG. 5 is a block diagram illustrating a configuration of a decoder and a three-dimensional acoustic renderer in the stereophonic audio reproducing apparatus, according to an embodiment.

FIG. 5 is a block diagram illustrating a configuration of a decoder and a 3D acoustic renderer in the stereophonic audio reproducing, according to an embodiment.

Referring to FIG. 5, according to an embodiment, the stereophonic audio reproducing apparatus 100 is shown based on a configuration of the decoder 110 and the 3D acoustic renderer 120, and the other configuration is omitted.

An audio signal input to the stereophonic audio reproducing apparatus 100 is an encoded signal and is input in a bitstream format. The decoder 110 decodes the input audio signal by selecting a decoder tool suitable for a scheme by which the audio signal was encoded and transmits the decoded audio signal to the 3D acoustic renderer 120.

The 3D acoustic renderer 120 includes an initialization unit 125 for obtaining and updating a filter coefficient and a panning coefficient and a rendering unit 127 for performing filtering and panning.

The rendering unit 127 performs filtering and panning on the audio signal transmitted from the decoder. A filtering unit 1271 processes information about a location of a sound so that a rendered audio signal is reproduced at a desired location, and a panning unit 1272 processes information about a tone of the sound so that the rendered audio signal has a tone suitable for the desired location.

The filtering unit 1271 and the panning unit 1272 perform similar functions to those of the filtering unit 121 and the panning unit 123 described with reference to FIG. 2. However, the filtering unit and the panning unit 123 of FIG. 2 are schematically shown, and it will be understood that a configuration, such as an initialization unit, for obtaining a filter coefficient and a panning coefficient may be omitted.

In this case, a filter coefficient to be used for filtering and a panning coefficient to be used for panning are transmitted from the initialization unit 125. The initialization unit 125 includes an elevation rendering parameter acquisition unit 1251 and an elevation rendering parameter update unit 1252.

The elevation rendering parameter acquisition unit 1251 obtains an initialization value of an elevation rendering parameter by using a configuration and a layout of output channels, i.e., loud speakers. In this case, the initialization value of the elevation rendering parameter is calculated based on a configuration of output channels according to a standard layout and a configuration of input channels according to an elevation rendering setup, or for the initialization value of the elevation rendering parameter, a pre-stored initialization value is read according to a mapping relationship between input/output channels. The elevation rendering parameter may include a filter coefficient to be used by the filtering unit 1251 or a panning coefficient to be used by the panning unit 1252.

However, as described above, a deviation between a set elevation value for the elevation rendering and settings of input channels may exist. In this case, when a fixed set elevation value is used, it is difficult to achieve the purpose of virtual rendering of three-dimensionally reproducing an original 3D audio signal to be more similar through output channels having a different configuration from that of input channels.

For example, when a sense of elevation is too high, a phenomenon in which an audio image is small and sound quality is deteriorated may occur, and when a sense of elevation is too low, a problem that it is difficult to feel an effect of virtual rendering may occur. Therefore, it is necessary to adjust a sense of elevation according to settings of a user or a degree of virtual rendering suitable for an input channel.

The elevation rendering parameter update unit 1252 updates the elevation rendering parameter by using initialization values of the elevation rendering parameter, which are obtained by the elevation rendering parameter acquisition unit 1251, based on elevation information of an input channel or a user's set elevation. In this case, if a speaker layout of output channels has a deviation as compared with the standard layout, a process for correcting an influence according to the deviation may be added. The output channel deviation may include deviation information according to an elevation angle difference or an azimuth angle difference.

An output audio signal filtered and panned by the rendering unit 127 by using the elevation rendering parameter obtained and updated by the initialization unit 125 is reproduced through a speaker corresponding to each output channel.

Figure 6:
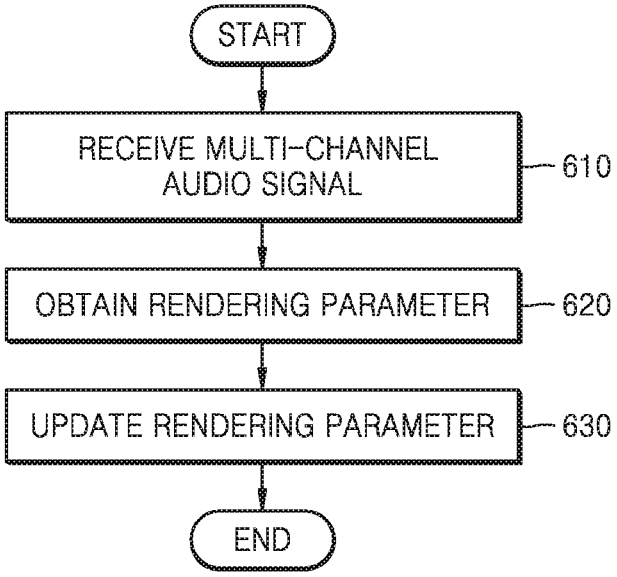
FIG. 6 is a flowchart illustrating a method of rendering a three-dimensional audio signal, according to an embodiment.

FIG. 6 is a flowchart illustrating a method of rendering a 3D audio signal, according to an embodiment.

In operation 610, a renderer receives a multi-channel audio signal including a plurality of input channels. The input multi-channel audio signal is converted into a plurality of output channel signals through rendering. For example, in down-mixing in which the number of input channels is greater than the number of output channels, an input signal having 22.2 channels is converted into an output signal having 5.1 channels.

As such, when a 3D stereophonic input signal is rendered using 2D output channels, normal rendering is applied to horizontal input channels, and virtual rendering for granting a sense of elevation is applied to height input channels having an elevation angle.

To perform rendering, a filter coefficient to be used for filtering and a panning coefficient to be used for panning are necessary. In this case, in operation 620, a rendering parameter is obtained according to a standard layout of output channels and a default elevation angle for virtual rendering in an initialization process. The default elevation angle may be variously determined according to renderers, but when the virtual rendering is performed using such a fixed elevation angle, a result of decreasing a satisfaction level and effect of the virtual rendering according to tastes of users or characteristics of input signals may occur.

Therefore, when a configuration of output channels has a deviation from a standard layout of corresponding output channels or an elevation with which the virtual rendering has to be performed differs from the default elevation, the rendering parameter is updated in operation 630.

In this case, the updated rendering parameter may include a filter coefficient updated by applying a weight determined based on an elevation angle deviation to an initialization value of the filter coefficient or a panning coefficient updated by increasing or decreasing an initialization value of the panning coefficient according to a magnitude comparison result between an elevation of an input channel and the default elevation.

A specific method of updating a filter coefficient and a panning coefficient will be described in more detail with reference to FIGS. 7 and 8.

If the speaker layout of the output channels has a deviation as compared with the standard layout, a process for correcting an influence according to the deviation may be added, but a description of a specific method of the process is omitted. The output channel deviation may include deviation information according to an elevation angle difference or an azimuth angle difference.

FIG. 7 illustrates a change in an audio image and a change in an elevation filter according to elevations of channels, according to an embodiment.

Figure 7A:
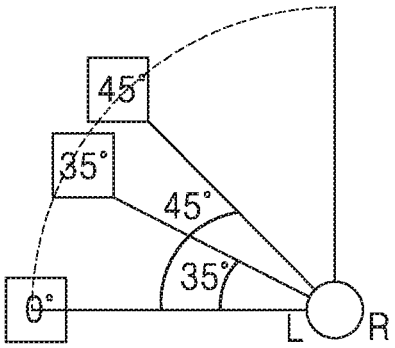
FIG. 7A illustrates a location of each channel when elevations of height channels are 0°, 35°, and 45°, according to an embodiment.

FIG. 7A illustrates a location of each channel when elevations of height channels are 0°, 35°, and 45°, according to an embodiment. The drawing of FIG. 7A is a figure viewed from the rear of an audience, and the channels shown in FIG. 7A are the ML90 channel or the TL90 channel. When an elevation angle is 0°, the channel exists on the horizontal surface and corresponds to the ML90 channel, and when elevation angles are 35° and 45°, the channels are upper-layer channels and correspond to the TL90 channel.

Figure 7B:
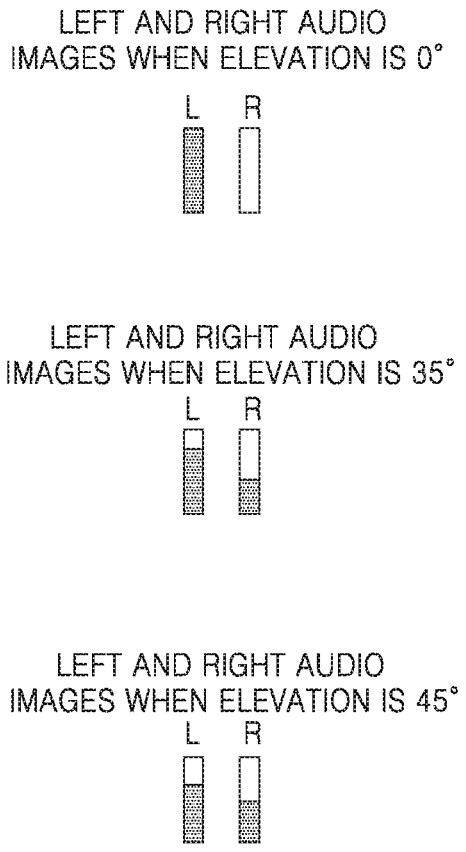
FIG. 7B illustrates a difference between signals felt by the left and right ears of an audience when an audio signal is output in each channel according to the embodiment of FIG. 7B.

FIG. 7B illustrates a difference between signals felt by the left and right ears of an audience when an audio signal is output in each channel according to the embodiment of FIG. 7B.

When an audio signal is output from the ML90 channel having no elevation angle, the audio signal is recognized by only the left ear in principle, and the audio signal is not recognized by the right ear.

However, as the elevation increases, a difference between a sound recognized by the left ear and an audio signal recognized by the right ear is gradually reduced, and when an elevation angle becomes 90° when the elevation angle of a channel gradually increases, the channel becomes a channel located above the heads of the audience, i.e., the VOG channel, and thus the same audio signal is recognized by both the ears.

Therefore, a change in audio signals recognized by both the ears according to elevation angles is as shown in FIG. 7B.

For audio signals recognized by the left and right ears when an elevation angle is 0°, an audio signal is recognized by only the left ear, and no audio signal can be recognized by the right ear. In this case, an ILD and an ITD are maximized, and the audience recognizes an audio image of the ML90 channel existing in a left horizontal channel.

For a difference between audio signals recognized by the left and right ears when an elevation angle is 35° and audio signals recognized by the left and right ears when an elevation angle is 45°, the difference between the audio signals recognized by the left and right ears is reduced as the elevation angle is high, and according to this difference, the audience can feel a difference in a sense of elevation from an output audio signal.

An output signal of a channel having an elevation angle of 35° has features of a wide audio image and sweet spot and natural sound quality as compared with an output signal of a channel having an elevation angle of 45°, and the output signal of the channel having an elevation angle of 45° has a feature of obtaining a sense of a sound field by which a strong sense of immersion is provided as compared with the output signal of the channel having an elevation angle of 35°, although an audio image is narrowed and a sweet spot is also narrowed.

As described above, as an elevation angle increases, a sense of elevation increases, and thus a sense of immersion is stronger, but a width of an audio image is narrower. This phenomenon is because as an elevation angle is high, a physical location of a channel moves gradually inwards and is finally close to the audience.

Therefore, update of a panning coefficient according to a change in an elevation angle is determined as follows. The panning coefficient is updated so that an audio image is wider as an elevation angle increases and is updated so that an audio image is narrower as an elevation angle decreases.

For example, it is assumed that the default elevation angle for virtual rendering is 45° and the virtual rendering is performed by decreasing the elevation angle to 35°. In this case, rendering panning coefficients to be applied to output channels ipsilateral to a virtual channel to be rendered are increased, and panning coefficients to be applied to the remaining channels are determined through power normalization.

For a detailed description, it is assumed that a 22.2-channel input multi-channel signal is reproduced through output channels (speakers) of 5.1 channels. In this case, input channels having an elevation angle, to which virtual rendering is to be applied, among the 22.2-channel input channels are nine channels of CH_U_000 (T0), CH_U_L45 (TL45), CH_U_R45 (TR45), CH_U_L90 (TL90), CH_U_R90 (TR90), CH_U_L135 (TL135), CH_U_R135 (TR135), CH_U_180 (T180), and CH_T_000 (VOG), and the 5.1-channel output channels are five channels of CH_M_000, CH_M_L030, CH_M_R030, CH_M_L110, and CH_M_R110 existing on the horizontal surface (excluding a woofer channel).

As such, when the CH_U_L45 channel is rendered using 5.1 output channels, if the default elevation angle is 45° and it is desired to decrease the elevation angle to 35°, panning coefficients to be applied to the CH_M_L030 and CH_M_L110 channels that are output channels existing to be ipsilateral to the CH_U_L45 channel are updated to increase by 3 dB, and panning coefficients of the remaining three channels are updated to decrease so as to satisfy Equation 1.

$$\Sigma_{i=1}^{N} g_i = 1 \quad (1)$$

Herein, N denotes the number of output channels for rendering an arbitrary virtual channel, and $g_i$ denotes a panning coefficient to be applied to each output channel.

This process should be performed for each height input channel.

On the contrary, it is assumed that the default elevation angle for virtual rendering is 45° and the virtual rendering is performed by increasing the elevation angle to 55°. In this case, rendering panning coefficients to be applied to output channels ipsilateral to a virtual channel to be rendered are decreased, and panning coefficients to be applied to the remaining channels are determined through power normalization.

When the CH_U_L45 channel is rendered using the same 5.1 output channels as the example described above, if the default elevation angle is 45° and it is desired to increase the elevation angle to 55°, panning coefficients to be applied to the CH_M_L030 and CH_M_L110 channels that are output channels existing to be ipsilateral to the CH_U_L45 channel are updated to decrease by 3 dB, and panning coefficients of the remaining three channels are updated to increase so as to satisfy Equation 1.

However, as described above, when a sense of elevation is increased, it is needed to pay attention so as for left and right audio images not to be reversed due to panning coefficient update, and this will be described with reference to FIG. 8.

Hereinafter, a method of updating a tone filter coefficient is described with reference to FIG. 7C.

Figure 7C:
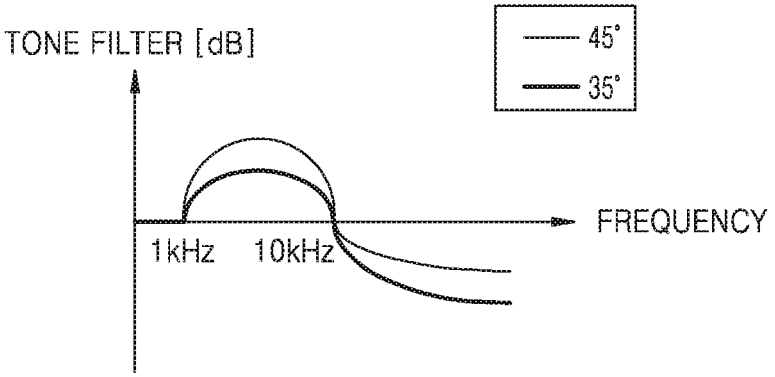
FIG. 7C illustrates features of a tone filter according to frequencies when elevation angles of channels are 35° and 45°, according to an embodiment.

FIG. 7C illustrates features of a tone filter according to frequencies when elevation angles of channels are 35° and 45°, according to an embodiment.

As shown in FIG. 7C, a tone filter of a channel having an elevation angle of 45° exhibits a greater feature due to the elevation angle as compared with a tone filter of a channel having an elevation angle of 35°.

As a result, when it is desired to perform virtual rendering so as to have a greater elevation angle than the standard elevation angle, a frequency band (a band of which an original filter coefficient is greater than 1) of which a magnitude should be increased when rendering the standard elevation angle is increased more (a updated filter coefficient is increased to be greater than 1), and a frequency band (a band of which an original filter coefficient is less than 1) of which a magnitude should be decreased when rendering the standard elevation angle is decreased more (a updated filter coefficient is decreased to be less than 1).

When this filter magnitude feature is shown by a decibel scale, as shown in FIG. 7C, a filter magnitude has a positive value in a frequency band in which a magnitude of an output signal should be increased, and has a negative value in a frequency band in which a magnitude of an output signal should be decreased. In addition, as shown in FIG. 7C, as an elevation angle decreases, a shape of a filter magnitude becomes smooth.

When a height channel is virtually rendered using a horizontal channel, the height channel has a similar tone to that of the horizontal channel as an elevation angle decreases, and a change in a sense of elevation increases as the elevation angle increases, and thus as the elevation angle increases, an influence due to a tone filter is increased to emphasize a sense of elevation effect due to an increase of the elevation angle. On the contrary, as the elevation angle decreases, an influence due to a tone filter may be decreased to decrease a sense of elevation effect.

Therefore, for filter coefficient update according to a change in an elevation angle, an original filter coefficient is updated using a weight based on the default elevation angle and an actual elevation angle to be rendered.

When the default elevation angle for virtual rendering is 45°, and it is desired to decrease a sense of elevation by being rendered to 35° that is lower than the default elevation angle, coefficients corresponding to the filter of 45° in FIG. 7C are determined as initial values and should be updated to coefficients corresponding to the filter of 35°.

Therefore, when it is desired to decrease a sense of elevation by being rendered to 35° that is a lower elevation angle than 45° that is the default elevation angle, a filter coefficient should be updated so that both a valley and a ridge of a filter according to frequency bands are more gently corrected than the filter of 45°.

On the contrary, when the default elevation angle is 45° and it is desired to increase a sense of elevation by being rendered to 55° that is higher than the default elevation angle, a filter coefficient should be updated so that both a valley and a ridge of a filter according to frequency bands are more sharply than the filter of 45°.

Figure 8:
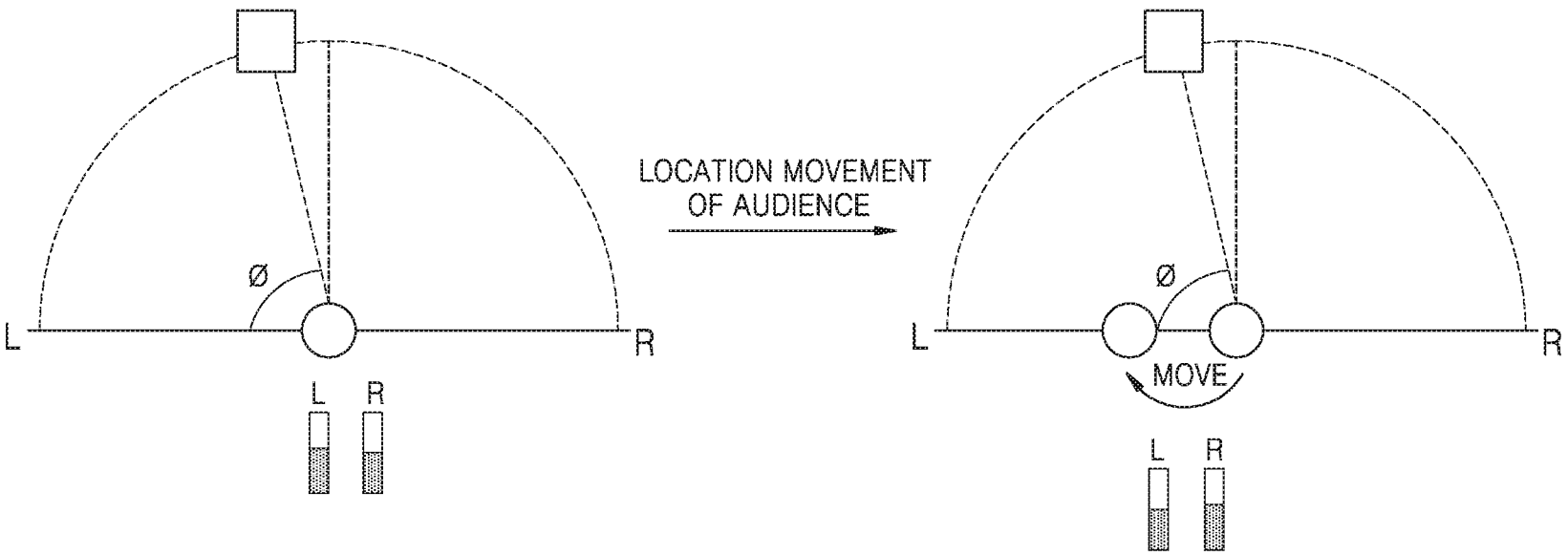
FIG. 8 illustrates a phenomenon in which left and right audio images are reversed when an elevation angle of an input channel is a threshold value or more, according to an embodiment.

FIG. 8 illustrates a phenomenon in which left and right audio images are reversed when an elevation angle of an input channel is a threshold value or more, according to an embodiment.

Like the case of FIG. 7B, FIG. 8 shows a figure viewed from the rear of an audience, and a channel marked with a rectangle is the CH_U_L90 channel. In this case, when it is assumed that an elevation angle of the CH_U_L90 channel is φ, as φ increases, an ILD and an ITD of audio signals arriving at the left and right ears of the audience gradually decrease, and the audio signals recognized by both the ears have similar audio images. A maximum value of the elevation angle φ is 90°, and when φ becomes 90°, the CH_U_L90 channel becomes the VOG channel existing above the heads of the audience, and the same audio signal is received by both the ears.

As shown in FIG. 8A, when φ has a considerably large value, a sense of elevation increases so that the audience can feel a sense of sound field by which a storing sense of immersion is provided. However, according to the increase of the sense of elevation, an audio image is narrowed, and a sweet spot is formed to be narrowed, and thus even when a location of the audience moves a little or a channel deviates a little, a left/right reversal phenomenon of audio images may occur.

FIG. 8B illustrates locations of the audience and the channel when the audience moves a little to the left. Since the sense of elevation is formed to be high due to a large value of the channel elevation angle φ, even when the audience moves a little, relative locations of left and right channels are largely changed, and in the worst case, a signal arriving at the right ear from a left channel is recognized to be greater than a signal arriving at the left ear from the left channel, and thus left/right reversal of audio images may occur as shown in FIG. 8B.

In a rendering process, rather than granting a sense of elevation, maintaining a left/right balance of audio images and localizing left and right locations of the audio images are more important problems, and thus in order for such a situation as the left/right reversal of audio images not to occur, it may be necessary that an elevation angle for virtual rendering is limited to a predetermined range or less.

Therefore, when an elevation angle is increased to obtain a higher sense of elevation than the default elevation angle for rendering, a panning coefficient should be decreased, but a minimum threshold value of the panning coefficient needs to be set so that the panning coefficient is not a predetermined value or less.

For example, even when a rendering elevation of 60° or more is increased to 60° or more, if panning is performed by compulsively applying a panning coefficient updated for a threshold elevation angle 60°, the left/right reversal phenomenon of audio images may be prevented.

Figure 9:
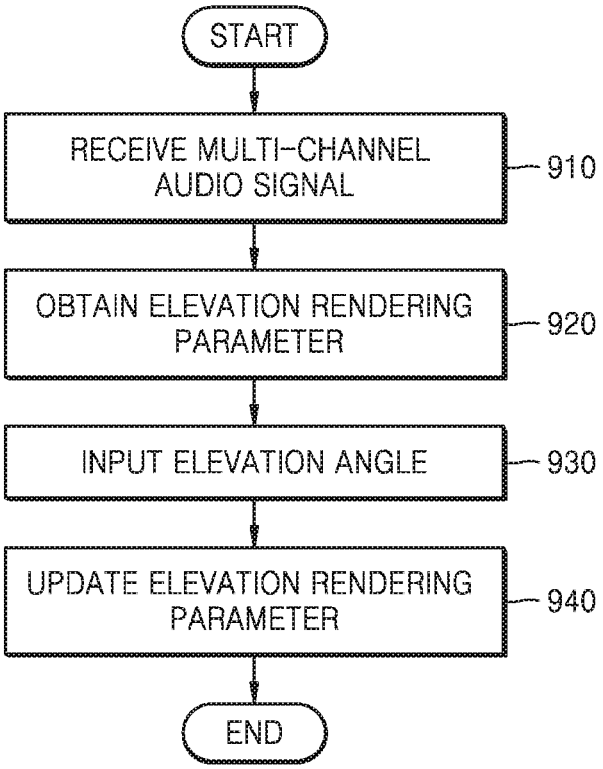
FIG. 9 is a flowchart illustrating a method of rendering a three-dimensional audio signal, according to another embodiment.

FIG. 9 is a flowchart illustrating a method of rendering a 3D audio signal, according to another embodiment.

In the embodiments described above, a method of performing virtual rendering based on a height channel of an input multi-channel signal when an elevation angle of the height channel of the input signal differs from a default elevation angle of a renderer has been described. However, it is necessary to variously change an elevation angle for virtual rendering according to tastes of users or features of spaces in which an audio signal is to be reproduced.

As such, when it is necessary to variously change an elevation angle for virtual rendering, it is necessary to add an operation of receiving an input of an elevation angle for rendering to the flowchart of FIG. 6, and the other operations are similar to the operations of FIG. 6.

In operation 910, a renderer receives a multi-channel audio signal including a plurality of input channels. The input multi-channel audio signal is converted into a plurality of output channel signals through rendering. For example, in down-mixing in which the number of input channels is greater than the number of output channels, an input signal having 22.2 channels is converted into an output signal having 5.1 channels.

As such, when a 3D stereophonic input signal is rendered using 2D output channels, normal rendering is applied to horizontal input channels, and virtual rendering for granting a sense of elevation is applied to height channels having an elevation angle.

To perform rendering, a filter coefficient to be used for filtering and a panning coefficient to be used for panning are necessary. In this case, in operation 920, a rendering parameter is obtained according to a standard layout of output channels and a default elevation angle for virtual rendering in an initialization process. The default elevation angle may be variously determined according to renderers, but when the virtual rendering is performed using such a fixed elevation angle, a result of decreasing an effect of the virtual rendering according to tastes of users, characteristics of input signals, or characteristics of reproducing spaces may occur.

Therefore, in operation 930, an elevation angle for the virtual rendering is input to perform the virtual rendering with respect to an arbitrary elevation angle. In this case, as the elevation angle for the virtual rendering, an elevation angle directly input by a user through a user interface of an audio reproducing apparatus or using a remote control may be delivered to the renderer.

Alternatively, the elevation angle for the virtual rendering may be determined by an application having information about a space in which an audio signal is to be reproduced and delivered to the renderer, or delivered through a separate external apparatus instead of the audio reproducing apparatus including the renderer. An embodiment in which an elevation angle for virtual rendering is determined through a separate external apparatus will be described in more detail with reference to FIGS. 10 and 11.

Although it is assumed in FIG. 9 that an input of an elevation angle is received after obtaining an initialization value of an elevation rendering parameter by using a rendering initialization setup, the input of the elevation angle may be received in any operation before the elevation rendering parameter is updated.

When the elevation angle different from the default elevation angle is input, the renderer updates the rendering parameter based on the input elevation angle in operation 940.

In this case, the updated rendering parameter may include a filter coefficient updated by applying a weight determined based on an elevation angle deviation to an initialization value of the filter coefficient or a panning coefficient updated by increasing or decreasing an initialization value of the panning coefficient according to a magnitude comparison result between an elevation of an input channel and the default elevation as described with reference to FIGS. 7 and 8.

If the speaker layout of the output channels has a deviation as compared with the standard layout, a process for correcting an influence according to the deviation may be added, but a description of a specific method of the process is omitted. The output channel deviation may include deviation information according to an elevation angle difference or an azimuth angle difference.

As described above, when virtual rendering is performed by applying an arbitrary elevation angle according to tastes of users, features of audio reproducing spaces, or the like, a better satisfaction level in subjective evaluation of sound quality and the like may be provided to an audience as compared with a virtual 3D audio signal for which rendering has been performed according to a fixed elevation angle.

Figure 10:
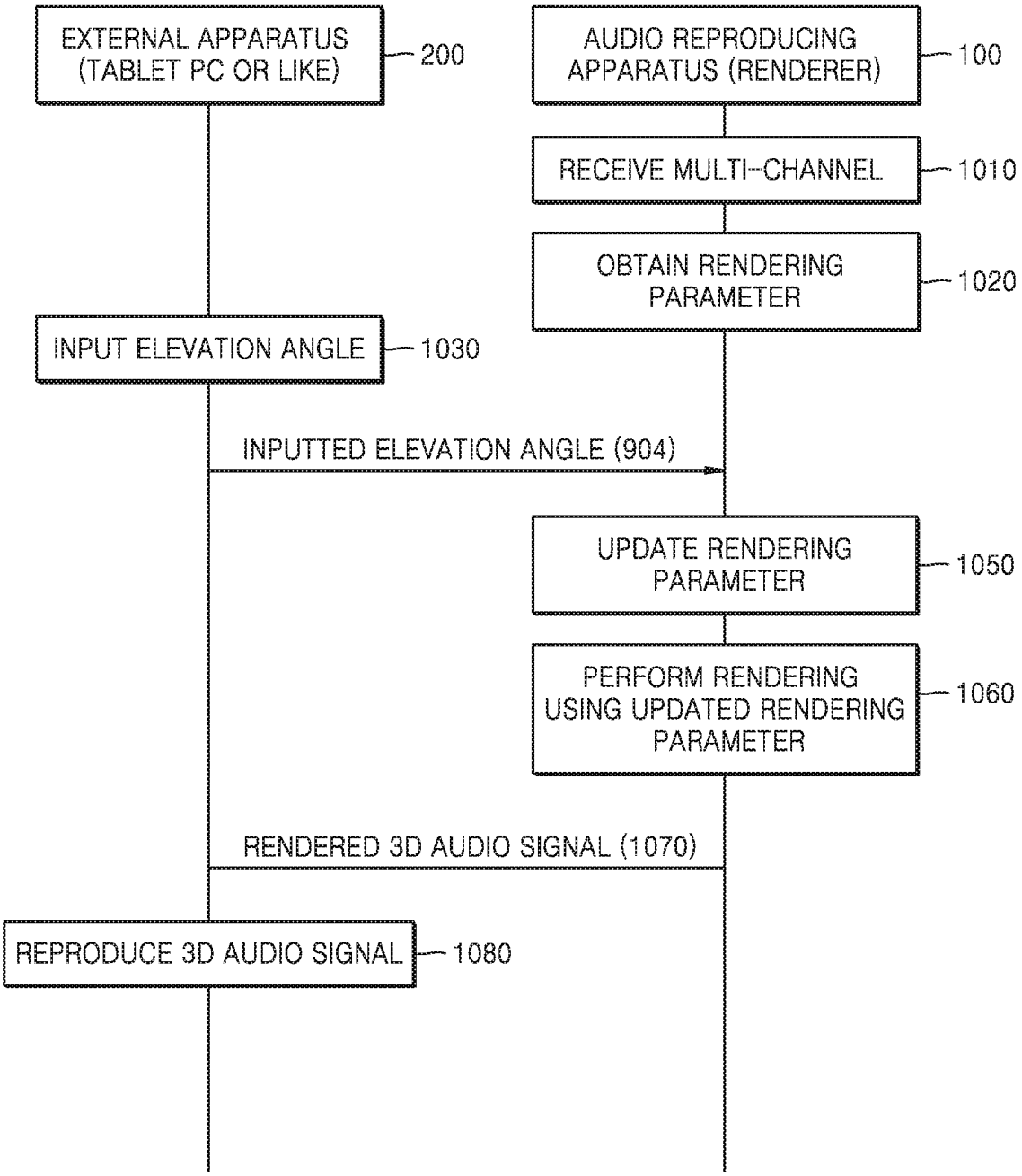
FIGS. 10 and 11 are signaling diagrams for describing an operation of each apparatus, according to an embodiment including at least one external apparatus and an audio reproducing apparatus.
Figure 11:
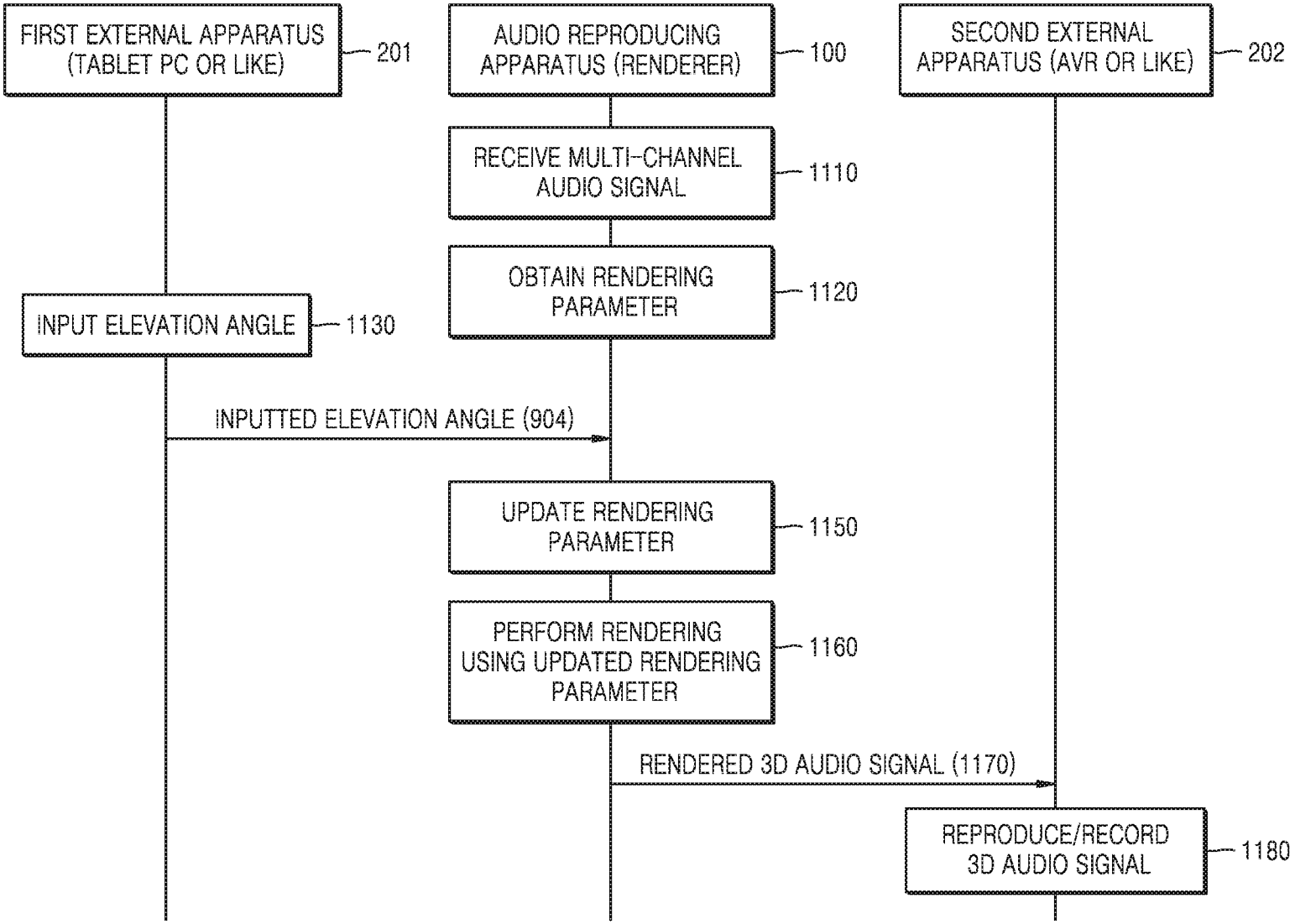

FIGS. 10 and 11 are signaling diagrams for describing an operation of each apparatus, according to an embodiment including at least one external apparatus and an audio reproducing apparatus.

FIG. 10 is a signaling diagram for describing an operation of each apparatus when an elevation angle is input through an external apparatus, according to an embodiment of a system including the external apparatus and the audio reproducing apparatus.

Along with the development of tablet PC and smartphone technologies, techniques of interworking and using an audio/video reproducing apparatus and a tablet PC or the like also have been briskly developed. Simply, a smartphone may be used as a remote control for the audio/video reproducing apparatus. Even for a TV including a touch function, most users control the TV by using a remote control since the users should move closely to the TV to input a command by using the touch function of the TV, and a considerable number of smartphones can perform a function of a remote control since they include an infrared terminal.

Alternatively, a tablet PC or a smartphone may control a decoding setup or a rendering setup by interworking with a multimedia device such as a TV or an audio/video receiver (AVR) through a specific application installed therein.

Alternatively, air-play for reproducing decoded and rendered audio/video content in a tablet PC or a smartphone by using a mirroring technique may be implemented.

In these cases, an operation between the stereophonic audio reproducing apparatus 100 including a renderer and an external apparatus 200 such as a tablet PC or a smartphone is as shown in FIG. 10. Hereinafter, an operation of the renderer in the stereophonic audio reproducing apparatus is mainly described.

When a multi-channel audio signal decoded by a decoder of the stereophonic audio reproducing apparatus 100 is received by the renderer in operation 1010, the renderer obtains a rendering parameter based on a layout of output channels and a default elevation angle in operation 1020. In this case, the obtained rendering parameter is obtained through reading a value pre-stored as an initialization value predetermined according to a mapping relationship between input channels and output channels or through a computation.

The external apparatus 200 for controlling a rendering setup of the audio reproducing apparatus transmits, to the audio reproducing apparatus in operation 1040, an elevation angle to be applied for rendering, which has been input by a user, or an elevation angle determined in operation 1030 as an optimal elevation angle through an application or the like.

When the elevation angle for rendering is input, the render updates the rendering parameter based on the input elevation angle in operation 1050 and performs rendering by using the updated rendering parameter in operation 1060. Herein, a method of updating the rendering parameter is the same as described with reference to FIGS. 7 and 8, and the rendered audio signal becomes a 3D audio signal having a sense of ambience.

The audio reproducing apparatus 100 may reproduce the rendered audio signal by itself, but when a request of the external apparatus 200 exists, the rendered audio signal is transmitted to the external apparatus in operation 1070, and the external apparatus reproduces the received audio signal in operation 1080 to provide a stereophonic sound having a sense of ambience to the user.

As described above, when air-play is implemented using the mirroring technique, even a portable device such as a tablet PC or a smartphone can provide a 3D audio signal by using a binaural technique and headphones enabling stereophonic audio reproducing.

FIG. 11 is a signaling diagram for describing an operation of each apparatus when an audio signal is reproduced through a second external apparatus, according to an embodiment of a system including a first external apparatus, the second external apparatus, and the audio reproducing apparatus.

The first external apparatus 201 of FIG. 11 indicates the external apparatus such as a tablet PC or a smartphone included in FIG. 10. The second external apparatus 202 of FIG. 11 indicates a separate acoustic system such as an AVR including a renderer other than the audio reproducing apparatus 100.

When the second external apparatus performs only rendering according to a fixed default elevation angle, a stereophonic sound having a better performance can be obtained by performing rendering using the audio reproducing apparatus according to an embodiment of the present invention and transmitting a rendered 3D audio signal to the second external apparatus so that the second external apparatus reproduces the rendered 3D audio signal.

When a multi-channel audio signal decoded by a decoder of the stereophonic audio reproducing apparatus is received by the renderer in operation 1110, the renderer obtains a rendering parameter based on a layout of output channels and a default elevation angle in operation 1120. In this case, the obtained rendering parameter is obtained through reading a value pre-stored as an initialization value predetermined according to a mapping relationship between input channels and output channels or through a computation.

The first external apparatus 201 for controlling a rendering setup of the audio reproducing apparatus transmits, to the audio reproducing apparatus in operation 1140, an elevation angle to be applied for rendering, which has been input by a user, or an elevation angle determined in operation 1130 as an optimal elevation angle through an application or the like.

When the elevation angle for rendering is input, the render updates the rendering parameter based on the input elevation angle in operation 1150 and performs rendering by using the updated rendering parameter in operation 1160. Herein, a method of updating the rendering parameter is the same as described with reference to FIGS. 7 and 8, and the rendered audio signal becomes a 3D audio signal having a sense of ambience.

The audio reproducing apparatus 100 may reproduce the rendered audio signal by itself, but when a request of the second external apparatus 202 exists, the rendered audio signal is transmitted to the second external apparatus 202, and the second external apparatus reproduces the received audio signal in operation 1080. Herein, if the second external apparatus can record multimedia content, the second external apparatus may record the received audio signal.

In this case, when the audio reproducing apparatus 100 and the second external apparatus 201 are connected through a specific interface, a process of transforming the rendered audio signal into a format suitable for a corresponding interface transcoding the rendered audio signal by using another codec to transmit the rendered audio signal may be added. For example, the rendered audio signal may be transformed into a pulse code modulation (PCM) format for uncompressed transmission through a high definition multimedia interface (HDMI) interface and then transmitted.

As described above, by enabling rendering with respect to an arbitrary elevation angle, a sound field may be reconfigured by arranging virtual speaker locations implemented through virtual rendering to arbitrary locations desired by a user.

The above-described embodiments of the present invention may be implemented as computer instructions which may be executed by various computer means, and recorded on a computer-readable recording medium. The computer-readable recording medium may include program commands, data files, data structures, or a combination thereof. The program commands recorded on the computer-readable recording medium may be specially designed and constructed for the present invention or may be known to and usable by those of ordinary skill in a field of computer software. Examples of the computer-readable medium include magnetic media such as hard discs, floppy discs, and magnetic tapes, optical recording media such as compact CD-ROMs, and DVDs, magneto-optical media such as floptical discs, and hardware devices that are specially configured to store and carry out program commands, such as ROMs, RAMs, and flash memories. Examples of the program commands include a high-level language code that may be executed by a computer using an interpreter as well as a machine language code made by a complier. The hardware devices may be changed to one or more software modules to perform processing according to the present invention, and vice versa.

While the present invention has been described with reference to specific features such as detailed components, the limited embodiments, and the drawings, they are provided only to assist the general understanding of the present invention, and the present invention is not limited to the embodiments, and those of ordinary skill in the art to which the present invention belongs may perform various changes and modifications of the embodiments described herein.

Therefore, the idea of the present invention should not be defined only by the embodiments described above, and the appended claims, their equivalents, or all the scopes equivalently changed therefrom belong to the scope of the idea of the present invention.

The invention claimed is:

1. A method of rendering an audio signal, the method comprising the steps of:

receiving multi-channel signals including a height input channel signal of a predetermined elevation angle;

obtaining an elevation filter coefficient and an elevation panning coefficient for a height input channel signal of a standard elevation angle to provide an elevated sound image;

updating the elevation filter coefficient and the elevation panning coefficient based on the predetermined elevation angle, in case that the predetermined elevation angle is higher than the standard elevation angle; and rendering the multi-channel signals to a plurality of output channel signals, using the updated elevation filter coefficient and the updated elevation panning coefficient, to provide an elevated sound image by the plurality of output channel signals, wherein the elevation filter coefficient is related to a head-related transfer function, and wherein the updated elevation panning coefficient, for an output channel signal among the plurality of output channel signals ipsilateral to the height input channel signal having the predetermined elevation angle, is less than the elevation panning coefficient before the updating.

2. The method of claim 1, wherein updated elevation panning coefficient, for an output channel signal among the plurality of output channel signals contralateral to the height input channel signal having the predetermined elevation angle is greater than the elevation panning coefficient before the updating.

3. The method of claim 1, further comprising the step of receiving an input of the predetermined elevation angle.

4. The method of claim 3, wherein the input is received from a separate device.

5. The method of claim 1, further comprising the steps of:

rendering the received multi-channel signals based on the updated elevation filter coefficient and the updated elevation panning coefficient; and transmitting the rendered multi-channel signals to a reproducing unit.

6. An apparatus for rendering an audio signal, the apparatus comprising:

a reception unit for receiving multi-channel signals including a height input channel signal of a predetermined elevation angle; and a rendering unit for obtaining an elevation filter coefficient and an elevation panning coefficient, for a height input channel signal of a standard elevation angle to provide an elevated sound image, updating the elevation filter coefficient and the elevation panning coefficient based on the predetermined elevation angle, in case that the predetermined elevation angle is higher than the standard elevation angle, and rendering the multi-channel signals to a plurality of output channel signals, using the updated elevation filter coefficient and the updated elevation panning coefficient, to provide an elevated sound image by the plurality of output channel signals, wherein the elevation filter coefficient is related to a head-related transfer function, and wherein the updated elevation panning coefficient, for an output channel signal among the plurality of output channel signals ipsilateral to the height input channel signal having the predetermined elevation angle, is less than the elevation panning coefficient before the updating.

7. The apparatus of claim 6, wherein updated elevation panning coefficient, for an output channel signal among the plurality of output channel signals contralateral to the height input channel signal having the predetermined elevation angle is greater than the elevation panning coefficient before the updating.

8. The apparatus of claim 6, further comprising an input unit for receiving an input of the predetermined elevation angle.

9. The apparatus of claim 8, wherein the input is received from a separate device.

10. The apparatus of claim 6 wherein the rendering unit renders the received multi-channel signals based on the updated elevation filter coefficient and the updated elevation panning coefficient, and further comprising a transmission unit for transmitting the rendered multi-channel signals to a reproducing unit.

* * * * *